US009932148B2

(12) United States Patent
Chohfi

(10) Patent No.: US 9,932,148 B2
(45) Date of Patent: Apr. 3, 2018

(54) HANDLE ASSEMBLY FOR A PORTABLE PRESSURIZED GAS CYLINDER

(71) Applicant: AMTROL Licensing Inc., West Warwick, RI (US)

(72) Inventor: William Chohfi, Jupiter, FL (US)

(73) Assignee: AMTROL Licensing Inc., West Warwick, RI (US)

( * ) Notice: Subject to any disclaimer, the term of this patent is extended or adjusted under 35 U.S.C. 154(b) by 163 days.

(21) Appl. No.: 15/000,662

(22) Filed: Jan. 19, 2016

(65) Prior Publication Data

US 2016/0215928 A1 Jul. 28, 2016

Related U.S. Application Data

(60) Provisional application No. 62/107,116, filed on Jan. 23, 2015.

(51) Int. Cl.

| | |
|---|---|
| ***F17C 1/02*** | (2006.01) |
| ***B65D 25/28*** | (2006.01) |
| ***F17C 1/00*** | (2006.01) |

(52) U.S. Cl.

CPC ..... *B65D 25/28* (2013.01); *F17C 1/00* (2013.01); *B65D 2525/285* (2013.01); *F17C 2201/0104* (2013.01); *F17C 2201/032* (2013.01); *F17C 2201/058* (2013.01); *F17C 2203/0639* (2013.01); *F17C 2205/0165* (2013.01); *F17C 2205/0308* (2013.01); *F17C 2221/035* (2013.01); *F17C 2270/0745* (2013.01)

(58) Field of Classification Search

CPC ..... F17C 2205/0308; F17C 2205/0165; F17C 2201/058; B65D 2525/285

USPC ..... 220/725, 726, 727, 724, 649, 323, 293, 220/298, 319, 296

See application file for complete search history.

(56) References Cited

U.S. PATENT DOCUMENTS

| | | | | |
|---|---|---|---|---|
| 6,311,722 | B1 * | 11/2001 | Gounot | F17C 13/06 137/377 |
| 8,528,586 | B2 * | 9/2013 | Cannet | F17C 13/04 137/377 |
| 2007/0034631 | A1 * | 2/2007 | Minowa | B01D 29/21 220/298 |

FOREIGN PATENT DOCUMENTS

| | | | |
|---|---|---|---|
| EP | 1744094 | A2 | 1/2007 |
| EP | 2933547 | A1 | 10/2015 |
| WO | WO-1997/11309 | A1 | 3/1997 |

OTHER PUBLICATIONS

Extended Search Report dated Apr. 4, 2016 in connection with EP16152362.6.

* cited by examiner

*Primary Examiner* — Stephen Castellano
(74) *Attorney, Agent, or Firm* — Tucker Ellis LLP; Carlos Garritano

(57) ABSTRACT

A portable gas cylinder is disclosed which includes a gas cylinder including an upper portion having a valve port and an annular mounting collar surrounding the valve port, a handle assembly including a housing having a body portion configured to mate with the upper portion of the gas cylinder, a pair of diametrically opposed gripping handles extending upwardly from the body portion and a central aperture providing access to the valve port, wherein an annular retention channel is formed in an undersurface of the housing, extending about the periphery of the central aperture for receiving the mounting flange of the gas cylinder, and a blocking ring for securing the mounting flange of the gas cylinder within the retention channel of the handle assembly.

14 Claims, 7 Drawing Sheets

HANDLE ASSEMBLY FOR A PORTABLE PRESSURIZED GAS CYLINDER

CROSS-REFERENCE TO RELATED APPLICATIONS

The subject application claims the benefit of priority from U.S. provisional Patent application No. 62/107,116 filed Jan. 23, 2015, the disclosure of which is incorporated herein by reference in its entirety.

BACKGROUND OF THE INVENTION

1. Field of the Invention

The subject invention is directed to portable pressurized gas cylinders, and more particularly, to a handle assembly for a portable pressurized gas cylinder and a method of assembling the same.

2. Description of Related Art

A variety of pressurized gas cylinders have been used for storage and transportation of pressurized gas products for household and industrial. Many of these cylinders have traditionally been fabricated of steel. One problem for steel pressure cylinders has been portability. For steel cylinders, any handles provided are typically formed from the same steel material as the cylinder itself. Due to the properties of steel, these traditional handles have been problematic. The hardness of steel makes it unyielding when gripped, and makes it difficult to form ergonomic surfaces, all of which makes the traditional steel cylinders painful to handle, especially when filled to maximum capacity.

Attempts to form an ergonomic handle from steel have generally been limited by practicality due to the difficulty and expense involved. It is difficult and expensive to form a handle volume from a typical metallic shroud that adequately fills the hand for optimal ergonomics. The lack of volume in typical steel handles causes the contact zone of the cylinder with the hand to be too small. The weight distribution on the hand is therefore concentrated in a small area of the hand, which makes traditional cylinders painful and/or makes them effectively heavier than they actually are due to practical limitations on how much weight n be lifted comfortably by hand with such handles.

Such conventional methods and systems have generally been considered satisfactory far intended purpose. However, there is still a need in the art for handle grips that allow for improved ergonomics, and therefore improved portability. There also remains a need in the art for such grips that is easy and cost effective to manufacture and install. The present invention provides a solution for these problems.

SUMMARY OF THE INVENTION

The subject invention is directed to a new and unique portable gas cylinder which includes, among other things, a gas cylinder or tank including an upper portion having a valve port and an annular mounting collar surrounding the valve port, and a handle assembly including a housing having a body portion configured to mate with the upper portion of the gas cylinder.

The housing includes a pair of diametrically opposed gripping handles extending upwardly from the body portion and a central aperture providing access to the valve port. An annular retention channel is formed in an undersurface of the housing, extending about the periphery of the central aperture, for receiving the mounting collar of the gas cylinder. In addition, a blocking ring is provided for securing the mounting collar of the gas cylinder within the retention channel of the handle assembly.

Preferably, the mounting collar includes a plurality of circumferentially spaced apart radially outwardly extending arcuate flanges, and the annular retention channel includes a plurality of circumferentially spaced apart arcuate reception grooves for receiving the plurality of flanges when the handle assembly is rotated relative to the gas cylinder upon the mating thereof.

The annular retention channel further includes a plurality of circumferentially spaced apart arcuate seating areas adjacent to the plurality of circumferentially spaced apart arcuate reception grooves for initially accommodating the circumferentially spaced apart radially outwardly extending arcuate flanges prior to rotating the handle assembly relative to the gas cylinder.

The blocking ring includes an upper horizontal rim portion and lower vertical hub portion, and a pair of diametrically opposed engagement tangs extend downwardly from an outer periphery of the rim portion for engaging a pair of corresponding diametrically opposed engagement ports formed in the housing of the handle assembly on the periphery of the central aperture to prevent further rotation of the handle assembly relative to the gas cylinder by blocking an adjacent arcuate flange of the mounting collar from moving out of an arcuate reception grooves.

The blocking ring also includes a plurality of circumferentially spaced apart deflectable arcuate ramps that project radially outwardly from the hub portion to mechanically engage below the undersurface of housing to secure the blocking ring to the housing. The deflectable arcuate ramps of the blocking ring are adapted and configured to produce an audible sound upon engagement with the undersurface of the housing to provide an indication that the blocking ring is firmly secured to the housing.

The subject invention is also directed to a handle assembly for a portable gas cylinder that includes a housing having a body portion configured to mate with an upper portion of the gas cylinder and including a pair of diametrically opposed gripping handles extending upwardly from the body portion, the housing defining a central aperture for gaining access to a valve port of the cylinder, wherein an annular retention channel is formed in an undersurface of the housing, extending about the periphery of the central aperture, for receiving an annular mounting collar of the gas cylinder which surrounds the valve port. A blocking ring is provided for securing the mounting collar of the gas cylinder within the retention channel of the handle assembly.

The subject invention is also directed to a method of assembling a portable gas cylinder comprising the steps of: providing a gas cylinder for receiving a pressurized gas, the cylinder including an upper portion having a valve port and an annular mounting collar surrounding the valve port; providing a handle assembly including a housing configured to mate with the upper portion of the gas cylinder, the housing having a central aperture for gaining access to the valve port, and an annular retention channel formed in an undersurface of the housing, extending about the periphery of the central aperture for receiving the annular mounting collar of the gas cylinder; mating the housing of the handle assembly with the upper portion of the gas cylinder so that the mounting collar of the gas cylinder is located within the retention channel of the housing; and engaging a blocking ring within the aperture of the housing to secure the mounting collar of the gas cylinder within the retention channel of the housing.

The step of mating the housing of the handle assembly with the upper portion of the gas cylinder so that the mounting collar of the gas cylinder is located within the retention channel of the housing includes positioning a plurality of circumferentially spaced apart arcuate flanges extending radially outwardly from the mounting collar within a corresponding plurality of circumferentially spaced apart arcuate seating areas formed in the retention channel of the housing The method further includes the step of rotating the handle assembly relative to the gas cylinder to position the plurality of circumferentially spaced apart arcuate flanges extending radially outwardly from the annular mounting collar within a plurality of circumferentially spaced apart arcuate reception grooves formed within the reception channel of the housing.

The method further includes the step of engaging a pair of diametrically opposed engagement tangs formed on the blocking ring within a pair of corresponding diametrically opposed engagement ports formed in the housing of the handle assembly on the periphery of the central aperture to prevent further rotation of the handle assembly relative to the gas cylinder.

These and other features of the subject invention and the manner in which it is manufactured and employed will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make, use and assembly the portable gas cylinder of the subject invention without undue experimentation, preferred embodiments thereof will be described in detail herein below with reference to certain figures, wherein.

DETAILED DESCRIPTION OF PREFERRED EMBODIMENTS

Figure 1:
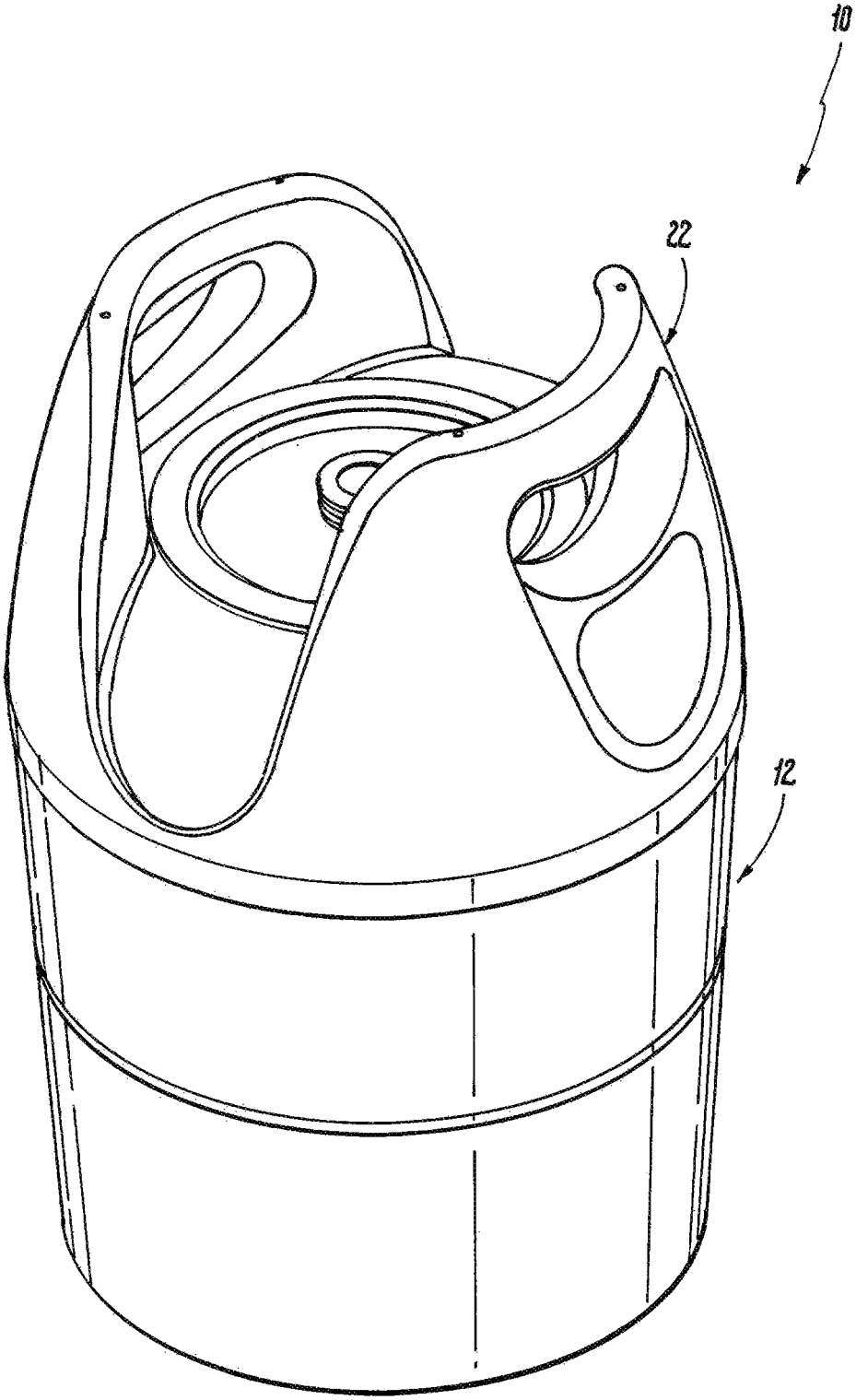
FIG. 1 is a perspective view of the upper portion of a portable gas cylinder constructed in accordance with a preferred embodiment of the subject invention.

Referring now to the drawings, wherein like reference numerals identify similar structural features or aspects of the subject invention, there is illustrated in FIG. 1 a new and unique portable gas cylinder designated generally by reference numeral 10. The portable gas cylinder of the subject invention provides a handle assembly 22 for a gas tank 12 with improved ergonomics and portability relative to prior art gas cylinders made from steel, and which are relatively easy and cost effective to manufacture and install.

Figure 2:
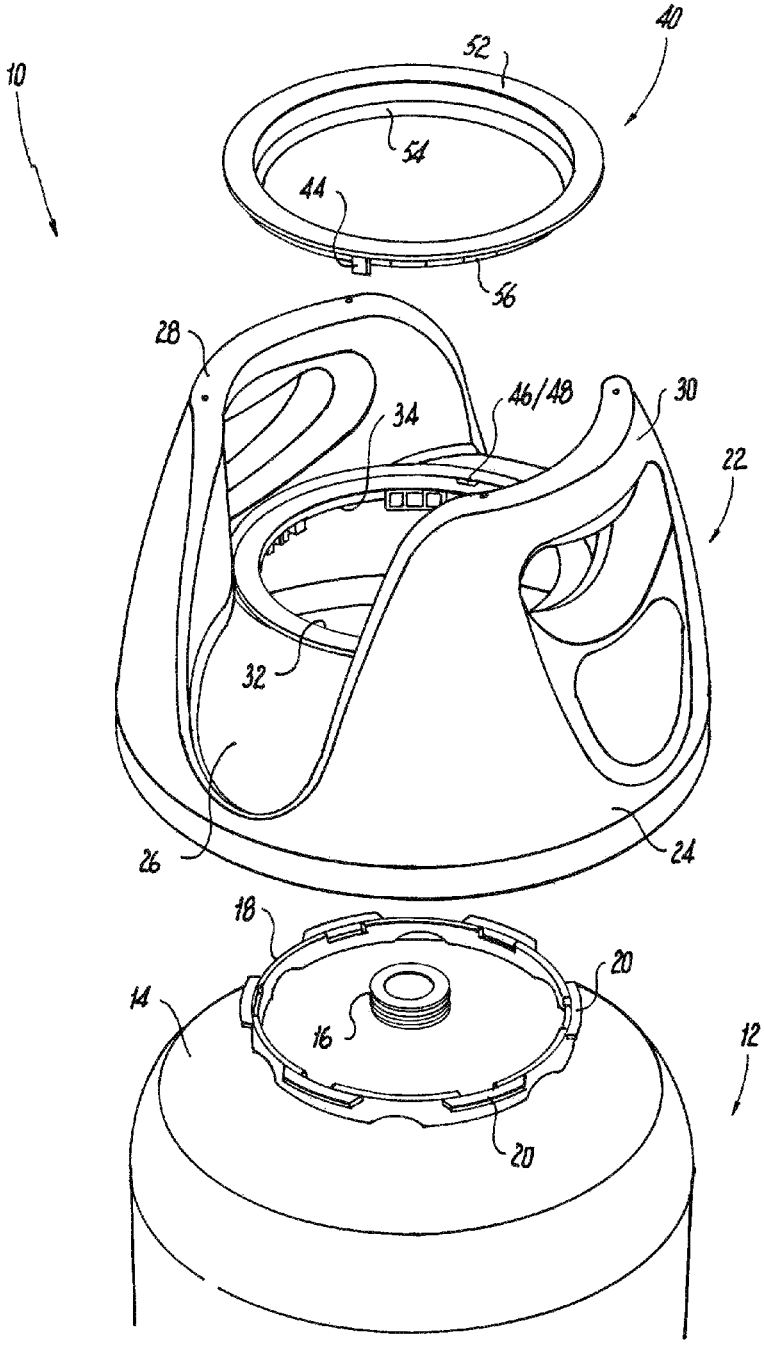
FIG. 2 is an exploded perspective view of the upper portion of the portable gas cylinder shown in FIG. 1, with parts separated for ease of illustration, including the annular mounting collar on the upper portion of the gas cylinder, the handle assembly which has a housing having a body portion for mating with the upper portion of the gas cylinder and the blocking ring which secures the body portion of the handle assembly to the mounting collar of the gas cylinder.

Referring to FIG. 2, the portable gas cylinder 10 includes a gas cylinder or tank 12 for receiving a pressurized gas, such as propane or the like. The gas tank 12 includes an upper portion 14 having a valve port 16 and an annular mounting collar 18 surrounding the valve port 16. The mounting collar 18 includes a plurality of circumferentially spaced apart radially outwardly extending arcuate flanges 20.

The portable gas cylinder 10 further includes a handle assembly 22 including a housing 24 having a body portion 26 configured to mate with the upper portion 14 of the gas tank 12. The housing 24 includes a pair of diametrically opposed gripping handles 28 and 30 extending upwardly from the body portion 26 and a central aperture 32 providing access to the valve port 16 of the gas tank 12.

Figure 3:
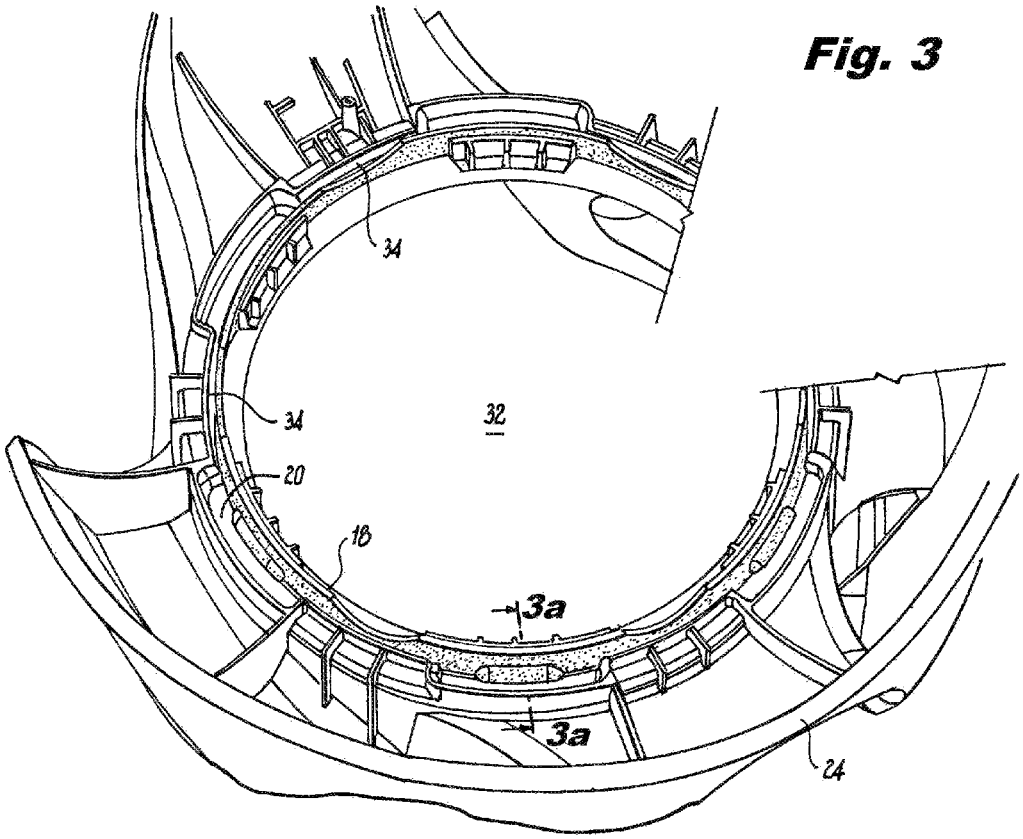
FIG. 3 is a perspective view of the underside of the handle assembly shown in FIGS. 1 and 2, wherein the mounting collar associated with the top portion of the gas cylinder is shown removed from the gas cylinder and engaged within the retention channel of the housing of the handle assembly.
Figure 3A:
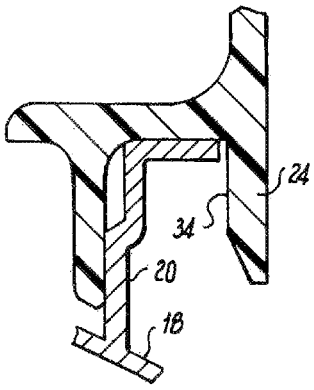
FIG. 3*a* is a localized cross-sectional view taken along line 3*a*-3*a* of FIG. 3 showing the local relationship of the mounting collar and retention channel when the radially outwardly projecting flanges of the mounting collar are initially spaced apart from the reception grooves of the retaining channel.

Referring to FIGS. 3 and 3*a*, an annular retention channel 34 is formed in an undersurface of the housing 24 of handle assembly 22, extending about the periphery of the central aperture 32, for receiving the mounting collar 18 of the gas tank 12. A blocking ring 40 is provided for securing the mounting collar 18 of the gas tank 12 within the retention channel 34 of the handle assembly 22.

Figure 4:
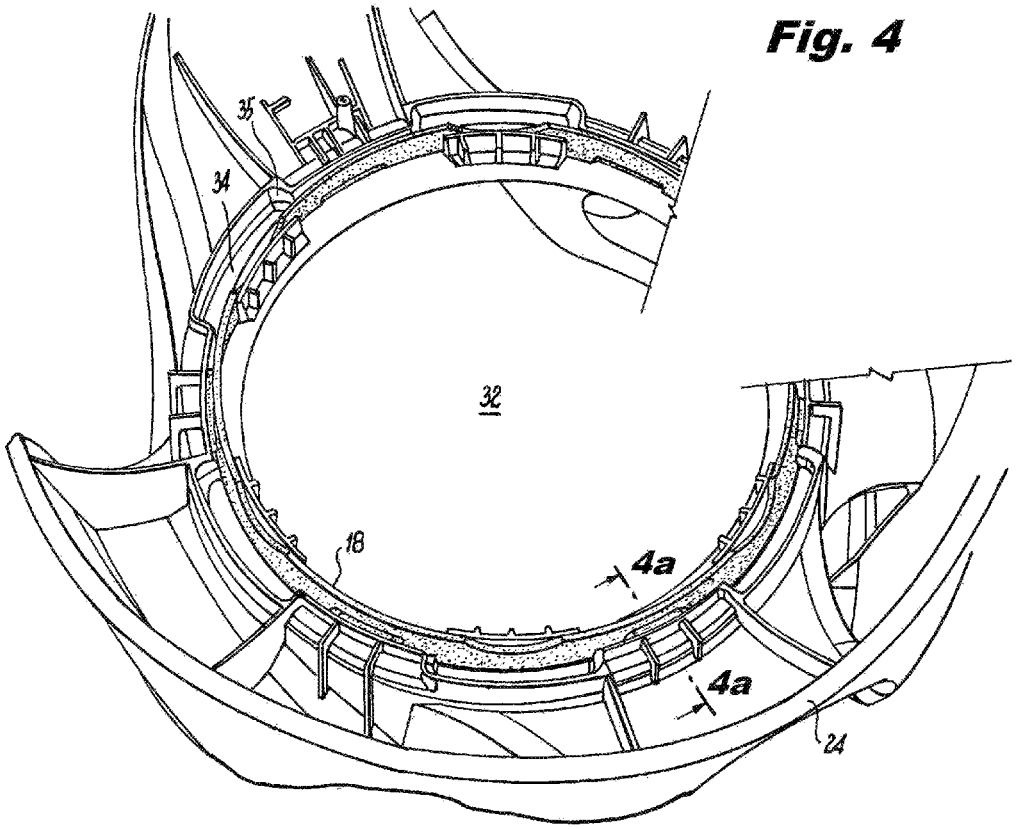
FIG. 4 is another perspective view of the underside of the handle assembly, wherein the housing of the handle assembly has been rotated relative to the gas cylinder through an angle of approximately 30 degrees, as illustrated by position of the mounting collar within the retention channel.
Figure 4A:
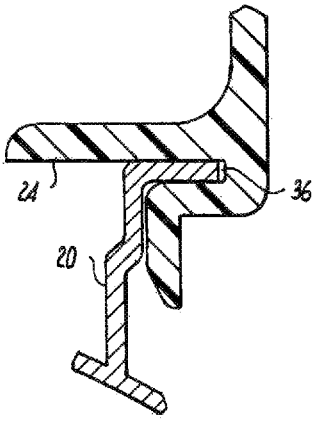
FIG. 4*a* is a localized cross-sectional view taken along line 4*a*-4*a* of FIG. 4 showing the local relationship of the mounting collar and retention channel when the radially outwardly projecting flanges of the mounting collar are engaged within the reception grooves of the retaining channel.

As best seen in FIGS. 4 and 4*a*, the annular retention channel 34 of the handle assembly 22 includes a plurality of circumferentially spaced apart arcuate seating areas 35 and a plurality of circumferentially spaced apart arcuate reception grooves 36 for receiving the plurality of arcuate flanges 20 when the handle assembly 22 is rotated relative to the gas tank 12 upon the mating thereof. The seating areas 35 are spaced to readily accommodate the arcuate flanges 20 during the handle assembly process.

As best seen in FIG. 2, the blocking ring 40 includes an upper horizontal rim portion 52 and lower vertical hub portion 54. A pair of diametrically opposed engagement tangs 42 and 44 extend from an outer periphery of the rim portion 52 for engaging a pair of corresponding diametrically opposed engagement ports 46 and 48 formed in the housing 24 of the handle assembly 22 on the periphery of the central aperture 32 (see FIG. 5). In addition, a plurality of circumferentially spaced apart deflectable ramps 56 project radially outwardly from the hub portion 54 of blocking ring 40, as shown in FIGS. 5 and 5*a*.

Figure 5:
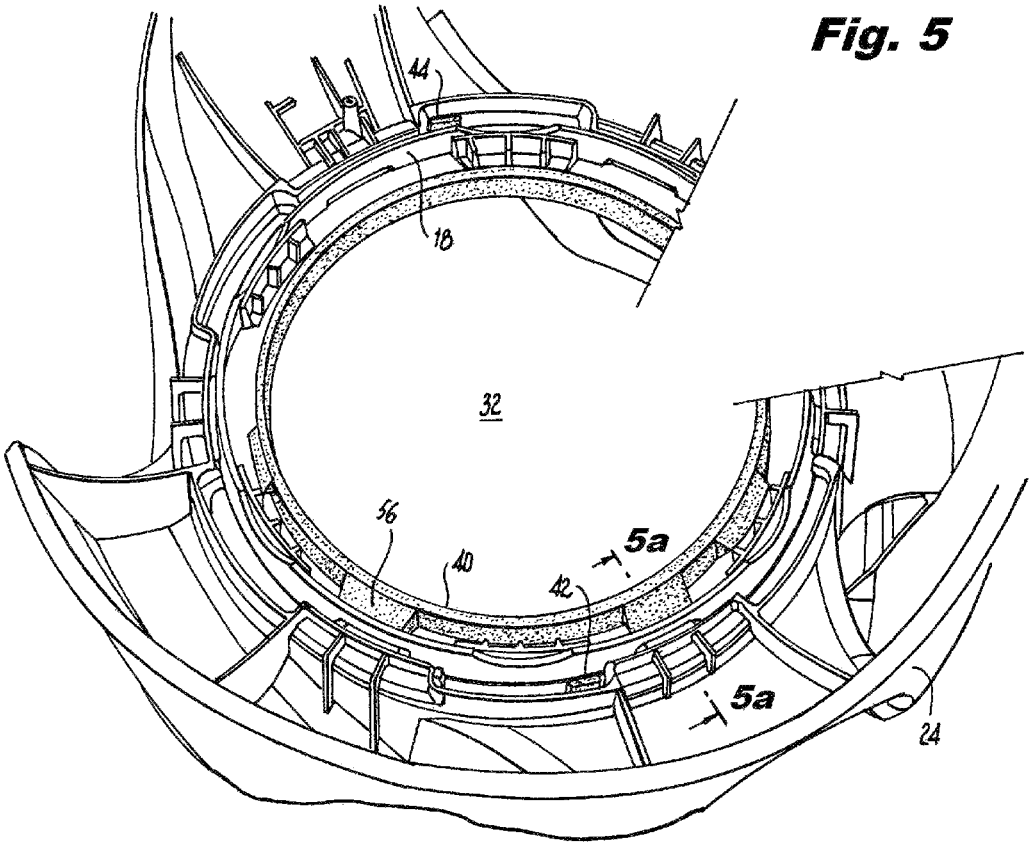
FIG. 5 is another perspective view of the underside of the handle assembly, wherein the blocking ring is engaged within the central aperture of the housing of the handle assembly, to mechanically secure the mounting collar of the gas cylinder within the retention channel of the handle assembly housing.
Figure 5A:
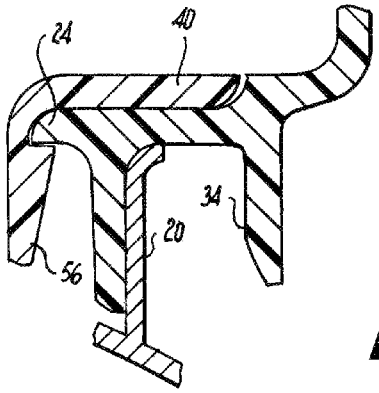
FIG. 5*a* is a localized cross-sectional view taken along line 5*a*-5*a* of FIG. 5 showing the local relationship of the mounting collar and retention channel when the blocking ring has been engaged.

The ramps 56 are adapted and configured to slide passed the periphery of the central aperture 32 while deflecting radially inwardly and then return to a neutral position mechanically engaged below the undersurface of housing 24, to secure the blocking ring 40 to the housing 24, as best seen in FIGS. 5 and 5*a*. Advantageously, upon mechanically engaging the ramps 56 of blocking ring 40 to housing 24, an audible indication is produced to enable the assembler to ensure that the blocking ring is firmly secured in place.

To assemble the portable gas cylinder 10 of the subject invention, the housing 24 of the handle assembly 22 is mated with the upper portion 14 of the gas tank 12 so that the mounting collar 18 of the gas tank 12 is located within the retention channel 34 of the housing 24, as illustrated in FIG. 3. At such a time, each arcuate mounting flange 20 of mounting collar 18 is initially accommodated within a corresponding seating area 35 of retention channel 34, as best seen in FIG. 3*a*.

Then, as shown in FIG. 4, the handle assembly 22 is rotated through an angle of approximately 30 degrees relative to the upper portion 14 of the gas tank 12. This serves to position the plurality of circumferentially spaced apart arcuate flanges 20 extending radially outwardly from the annular mounting collar 18 within the plurality of circumferentially spaced apart arcuate reception grooves 36 formed within the retention channel 34 of the housing 24, as best seen in FIG. 4*a*.

Thereafter, as illustrated in FIG. 5, the blocking ring 40 is engaged within the central aperture 32 of the housing 24 to secure the mounting collar 18 of the gas tank 12 within the retention channel 34 of the housing 24, as best seen in FIG. 5*a*. More particularly, the plurality of circumferentially spaced apart deflectable ramps 56 secure the blocking ring 40 to the undersurface of housing 24, as best seen in FIG. 5*a*. In addition, as illustrated, the pair of diametrically opposed engagement tangs 42 and 44 are engaged within the corresponding engagement ports 46 and 48 in the housing 24 of handle assembly 22.

Figure 6:
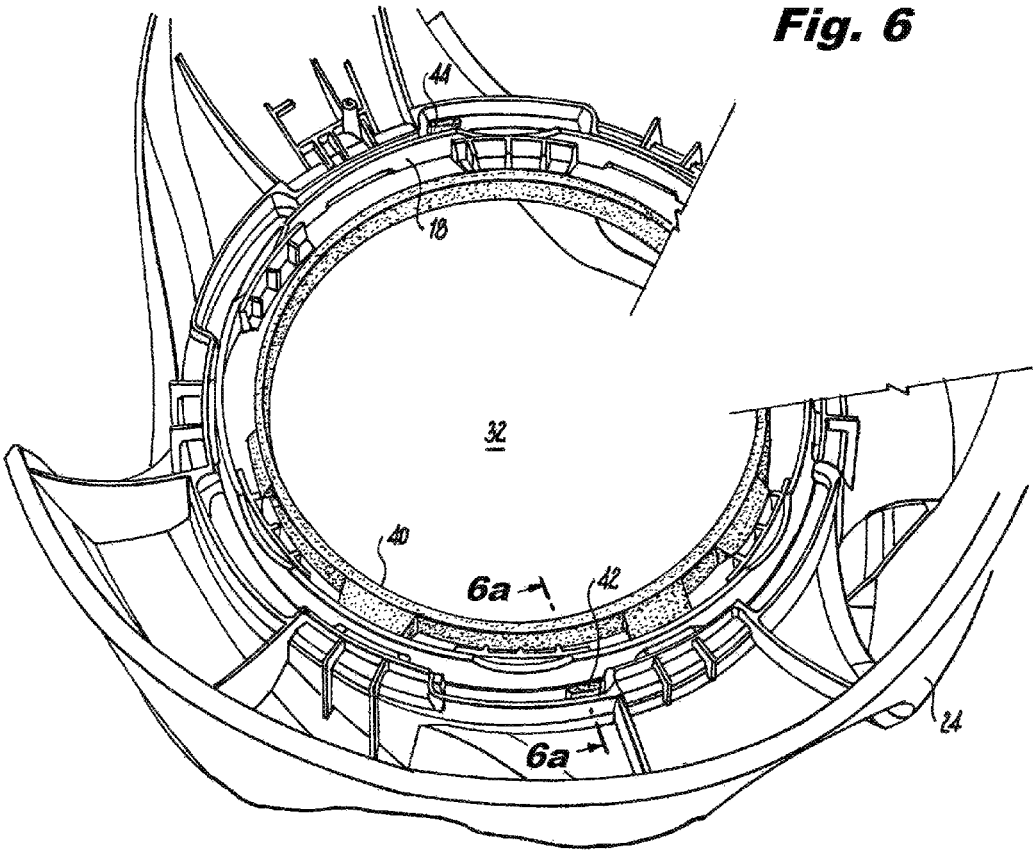
FIG. 6 is another perspective view of the underside of the handle assembly, with the blocking ring engaged, as in FIG. 5.
Figure 6A:
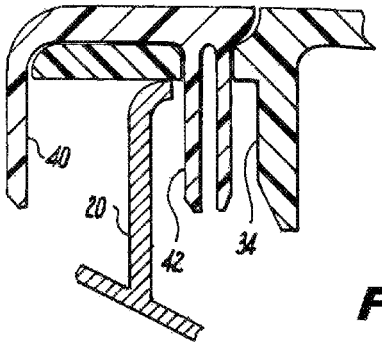
FIG. 6*a* is a localized cross-sectional view taken along line 6*a*-6*a* of FIG. 6 showing the radial extent of one of the diametrically opposed engagement tangs associated with the blocking ring.
Figure 7:
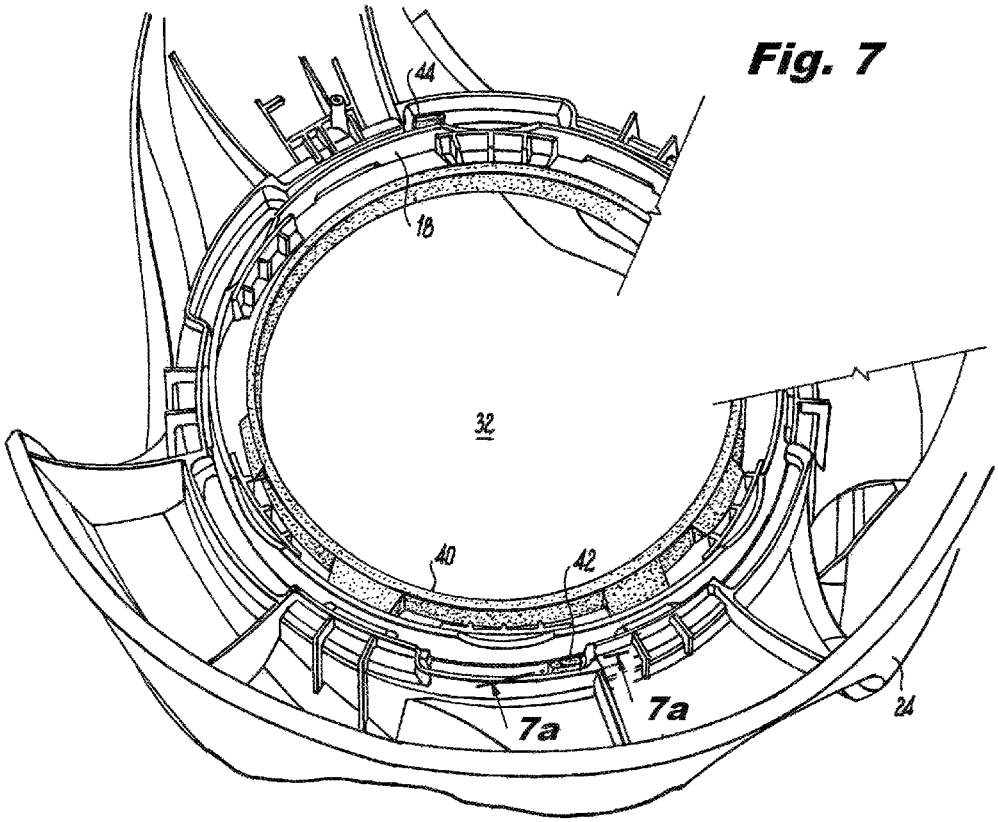
FIG. 7 is another perspective view of the underside of the handle assembly, with the blocking ring engaged, as in FIGS. 5 and 6.
Figure 7A:
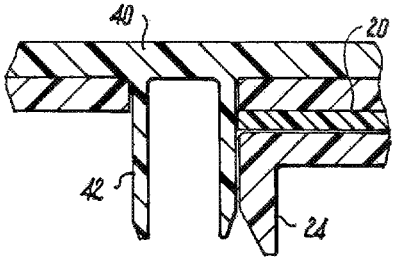
FIG. 7*a* is a localized cross-sectional view taken along line 7*a*-7*a* of FIG. 7 showing the transverse extent of the engagement tang shown in FIG. 6*a*.

Referring to FIGS. 6 and 7, when the tangs 42 and 44 are engaged within the ports 46 and 48, they effectively block or otherwise prevent the adjacent arcuate flanges 20 of mounting collar 18 from moving out of the arcuate reception grooves 36 of retention channel 34, as shown in FIGS. 6*a* and 7*a*.

While the subject invention has been shown and described with reference to preferred embodiments, those skilled in the art will readily appreciate that various changes and/or modifications may be made thereto without departing from the spirit and scope of the subject invention as defined by the appended claims.

What is claimed is:

1. A method of assembling a portable gas cylinder comprising the steps of:
   a) providing a gas cylinder for receiving a pressurized gas, the cylinder including an upper portion having a valve port and an annular mounting collar surrounding the valve port;
   b) providing a handle assembly including a housing configured to mate with the upper portion of the gas cylinder, the housing having a central aperture for gaining access to the valve port, and an annular retention channel formed in an undersurface of the housing, extending about the periphery of the central aperture for receiving the annular mounting collar of the gas cylinder;
   c) mating the housing of the handle assembly with the upper portion of the gas cylinder so that the mounting collar of the gas cylinder is located within the retention channel of the housing; and
   d) engaging a blocking ring within the aperture of the housing to secure the mounting collar of the gas cylinder within the retention channel of the housing.

2. A method of assembling a portable gas cylinder according to claim 1, wherein the step of mating the housing of the handle assembly with the upper portion of the gas cylinder so that the mounting collar of the gas cylinder is located within the retention channel of the housing includes positioning a plurality of circumferentially spaced apart arcuate flanges extending radially outwardly from the mounting collar within a corresponding plurality of circumferentially spaced apart arcuate seating areas formed in the retention channel of the housing.

3. A method of assembling a portable gas cylinder according to claim 1, further comprising the step of rotating the handle assembly relative to the gas cylinder to position the plurality of circumferentially spaced apart arcuate flanges extending radially outwardly from the annular mounting collar within a plurality of circumferentially spaced apart arcuate reception grooves formed within the reception channel of the housing.

4. A method of assembling a portable gas cylinder according to claim 3, further comprising the step of engaging a pair of diametrically opposed engagement tangs formed on the blocking ring within a pair of corresponding diametrically opposed engagement ports formed in the housing of the handle assembly on the periphery of the central aperture to prevent further rotation of the handle assembly relative to the gas cylinder.

5. A portable gas cylinder comprising:
   a) a gas cylinder including an upper portion having a valve port and an annular mounting collar surrounding the valve port;
   b) a handle assembly including a housing having a body portion configured to mate with the upper portion of the gas cylinder, a pair of diametrically opposed gripping handles extending upwardly from the body portion of the housing and a central aperture providing access to the valve port, wherein an annular retention channel is formed in an undersurface of the housing, extending about the periphery of the central aperture for receiving the mounting collar of the gas cylinder; and
   c) a blocking ring for securing the mounting collar of the gas cylinder within the retention channel of the handle assembly, wherein the mounting collar includes a plurality of circumferentially spaced apart radially outwardly extending arcuate flanges, and the annular retention channel includes a plurality of circumferentially spaced apart arcuate reception grooves for receiving the plurality of flanges when the handle assembly is rotated relative to the gas cylinder upon the mating thereof.

6. A portable gas cylinder as recited in claim 5, wherein the annular retention channel includes a plurality of circumferentially spaced apart arcuate seating areas adjacent to the plurality of circumferentially spaced apart arcuate reception grooves for initially accommodating the circumferentially spaced apart radially outwardly extending arcuate flanges prior to rotating the handle assembly relative to the gas cylinder.

7. A portable gas cylinder as recited in claim 5, wherein the blocking ring includes an upper horizontal rim portion and lower vertical hub portion, and wherein a pair of diametrically opposed engagement tangs extend downwardly from an outer periphery of the rim portion for engaging a pair of corresponding diametrically opposed engagement ports formed in the housing of the handle assembly on the periphery of the central aperture to prevent further rotation of the handle assembly relative to the gas cylinder by blocking an adjacent arcuate flange of the mounting collar from moving out of an arcuate reception grooves.

8. A portable gas cylinder as recited in claim 7, wherein the blocking ring includes a plurality of circumferentially spaced apart deflectable arcuate ramps that project radially outwardly from the hub portion to mechanically engage below the undersurface of housing to secure the blocking ring to the housing.

9. A portable gas cylinder as recited in claim 8, wherein the deflectable arcuate ramps of the blocking ring are adapted and configured to produce an audible sound upon engagement with the undersurface of the housing to provide an indication that the blocking ring is firmly secured to the housing.

10. A handle assembly for a portable gas cylinder comprising:

a) a housing having a body portion configured to mate with an upper portion of the gas cylinder and including a pair of diametrically opposed gripping handles extending upwardly from the body portion, the housing defining a central aperture for gaining access to a valve port of the cylinder, wherein an annular retention channel is formed in an undersurface of the housing, extending about the periphery of the central aperture, for receiving an annular mounting collar of the gas cylinder which surrounds the valve port; and b) a blocking ring for securing the mounting collar of the gas cylinder within the retention channel of the handle assembly, wherein the blocking ring includes an upper horizontal rim portion and lower vertical hub portion, and wherein a pair of diametrically opposed engagement tangs extend downwardly from an outer periphery of the rim portion for engaging a pair of corresponding diametrically opposed engagement ports formed in the housing of the handle assembly on the periphery of the central aperture to prevent further rotation of the handle assembly relative to the gas cylinder by blocking an adjacent arcuate flange of the mounting collar from moving out of an arcuate reception grooves.

11. A handle assembly for a portable gas cylinder as recited in claim 10, wherein the annular retention channel includes a plurality of circumferentially spaced apart arcuate reception grooves for receiving a plurality of circumferentially spaced apart arcuate flanges extending radially outwardly from the annular mounting collar when the handle assembly is rotated relative to the gas cylinder upon the mating thereof.

12. A handle assembly for a portable gas cylinder as recited in claim 11, wherein the annular retention channel includes a plurality of circumferentially spaced apart arcuate seating areas adjacent to the plurality of circumferentially spaced apart arcuate reception grooves for initially accommodating the circumferentially spaced apart radially outwardly extending arcuate flanges prior to rotating the handle assembly relative to the gas cylinder.

13. A handle assembly for a portable gas cylinder as recited in claim 10, wherein the blocking ring includes a plurality of circumferentially spaced apart deflectable arcuate ramps that project radially outwardly from the hub portion to mechanically engage below the undersurface of housing to secure the blocking ring to the housing.

14. A handle assembly for a portable gas cylinder as recited in claim 13, wherein the deflectable arcuate ramps of the blocking ring are adapted and configured to produce an audible sound upon engagement with the undersurface of the housing to provide an indication that the blocking ring is firmly secured to the housing.

* * * * *